United States Patent [19]

Kurtz

[11] 4,017,072

[45] Apr. 12, 1977

[54] ELECTRICALLY OPERATED GAME APPARATUS

[76] Inventor: Lynn C. Kurtz, 2104 Campo Alegro, Tempe, Ariz. 85281

[22] Filed: July 9, 1975

[21] Appl. No.: 594,509

[52] U.S. Cl. ..... 273/1 E; 273/130 AB; 273/136 A

[51] Int. Cl.[2] ..... A63F 9/00

[58] Field of Search ..... 273/94 R, 85 R, 1 E, 273/130 AB, 131 A, 134 A, 136 A

[56] References Cited

UNITED STATES PATENTS

| | | | |
|---|---|---|---|
| 824,423 | 6/1906 | Hile | 273/136 A |
| 1,232,133 | 7/1917 | Warden | 273/131 A |
| 3,046,676 | 7/1962 | Hermann et al. | 273/136 A UX |
| 3,092,390 | 6/1963 | Super | 273/1 E |
| 3,152,805 | 10/1964 | McGinn | 273/136 A X |
| 3,503,608 | 3/1970 | Ylinen | 273/136 A X |
| 3,516,671 | 6/1970 | Estrin | 273/130 AB |
| 3,690,665 | 9/1972 | Becker | 273/130 AB |
| 3,814,426 | 6/1974 | Moe | 273/94 R |
| 3,887,189 | 6/1975 | Dawes | 273/130 AB |

*Primary Examiner*—William H. Grieb
*Attorney, Agent, or Firm*—Cahill, Sutton & Thomas

[57] ABSTRACT

An electrically operated game is disclosed having a matrix arranged play area of contiguous elements. Various elements of the matrix are designated as scoring elements for each player. One element is distinguished throughout the game. The location of the distinguished element is periodically moved to a contiguous element with a first player controlling the movement along one axis of the matrix and a second player controlling the movement along another axis of the matrix. Scoring by a player results from moving the distinguished element to a scoring element associated with that player. A display device records the score.

7 Claims, 3 Drawing Figures

ELECTRICALLY OPERATED GAME APPARATUS

BACKGROUND OF THE INVENTION

1. Field of the Invention

This invention relates generally to electrically operated games played between two or more players, and more particularly to a game embodying the controlled movement of a distinguished spot across the play area.

2. Discussion of the Prior Art

Electrically operated board games are quite old, dating at least back to 1906 with the issuance of U.S. Pat. No. 824,423 in which E. E. Hile disclosed a checkerboard type game in which two players alternately move pieces on the game board. The object of the game is to form a continuous electrical path from the border of the game board to the central region of the board, thereby causing a bell to ring. Various rules applied to frustrate the opponent's attempt to construct such a continuous path.

The failure of the Hile game to become widely popular is attributable to at least two factors. First, the alternating moves by each player make the game inherently slow moving. Secondly, as set forth at page 2, from lines 47 to 82, the game is controlled by a complicated set of rules which are beyond the comprehension of many youthful players and beyond the interest of many adult players.

U.S. Pat. No. 3,152,805 discloses a more sophisticated electrically operated matrix game. In this game the various squares making up the matrix of the game board contain numbers and an identifying indication to associate the number with a particular player. A first player selects a row of the matrix while a second player coincidentally selects a column of the matrix during each move of the game. The square located in both the selected row and the selected column is lighted. The player associated with that square is awarded a number of points corresponding to the number indicated on that square. Although this game is fast-paced and simple to play, there is little opportunity for the players to acquire skill in playing the game since the scoring square is very much a matter of luck. as a result, players rapidly lose interest in the generally haphazard scoring associated with the game.

Another attempt to create excitment in the play of a board game is disclosed in U.S. Pat. No. 3,503,608 in which a central light is intermittently illuminated. When the central light is illuminated, the opposing players press their respective scoring buttons. The first of the buttons to be depressed produces a score for its associated player. Thus, the reaction time of the players becomes an appreciable factor in the play of the game. Unfortunately, the relative simplicity of the game, and its repetitive character, result in a rapid waning of interest on the part of the players.

Although not disclosed as a game, U.S. Pat. No. 3,045,676 could be adapted as such. The patent discloses a video screen on which a simulated target trace is imposed. By operating a control mechanism, a marksman can steer an imaginary missile to intersect the target on the video display screen. The path of the target vehicle is initially determined by an instructor, while the path of the missile is altered under control of the marksman operating a direction selection device. Even if adapted for a game, such a device has several significant shortcomings. First, it is not an action-reaction type game in which the move of one player is responsive to the move of another player. Further because the target area is movable, only nominal game logic can be employed, with the skill of the operator being merely to approach intersection with the moving target. Lastly, since the position of both the target and the simulated attack missile are continually changing, no incremental control of either target or attack missile is provided, making strategic maneuvers by the players meaningless.

It is therefore an object of this invention to provide a fast-paced game in which opposing players simultaneously make their moves.

It is another object of this invention to provide a game having few, but easily understood rules.

It is yet another object of this invention to provide a game requiring skill on the part of the player to overcome the challenge of his adversary.

It is still another object of this invention to combine player reaction time with intelligent choice opportunity to sustain player interest in a board game.

It is a further object of this invention to provide a game board in which the position of the targets is unmovable while the position of the scoring marker is incrementally advanced in response to joint control of the opposing players.

SUMMARY OF THE INVENTION

A game board embodying this invention is disclosed which orients a plurality of elements in a matrix. Certain of the elements are designated as scoring targets for each player. One element of the board is distinguished at the start of the game and then periodically incremented to move the distinguished element to contiguous elements. The location of the distinguished element is controlled by a first player along the rows of the matrix and by a second player along the columns of the matrix. By maneuvering the distinguished element to coincide with a scoring target, the player associated with the scoring target is awarded a point.

DETAILED DESCRIPTION OF THE ILLUSTRATED EMBODIMENTS

Figure 1:
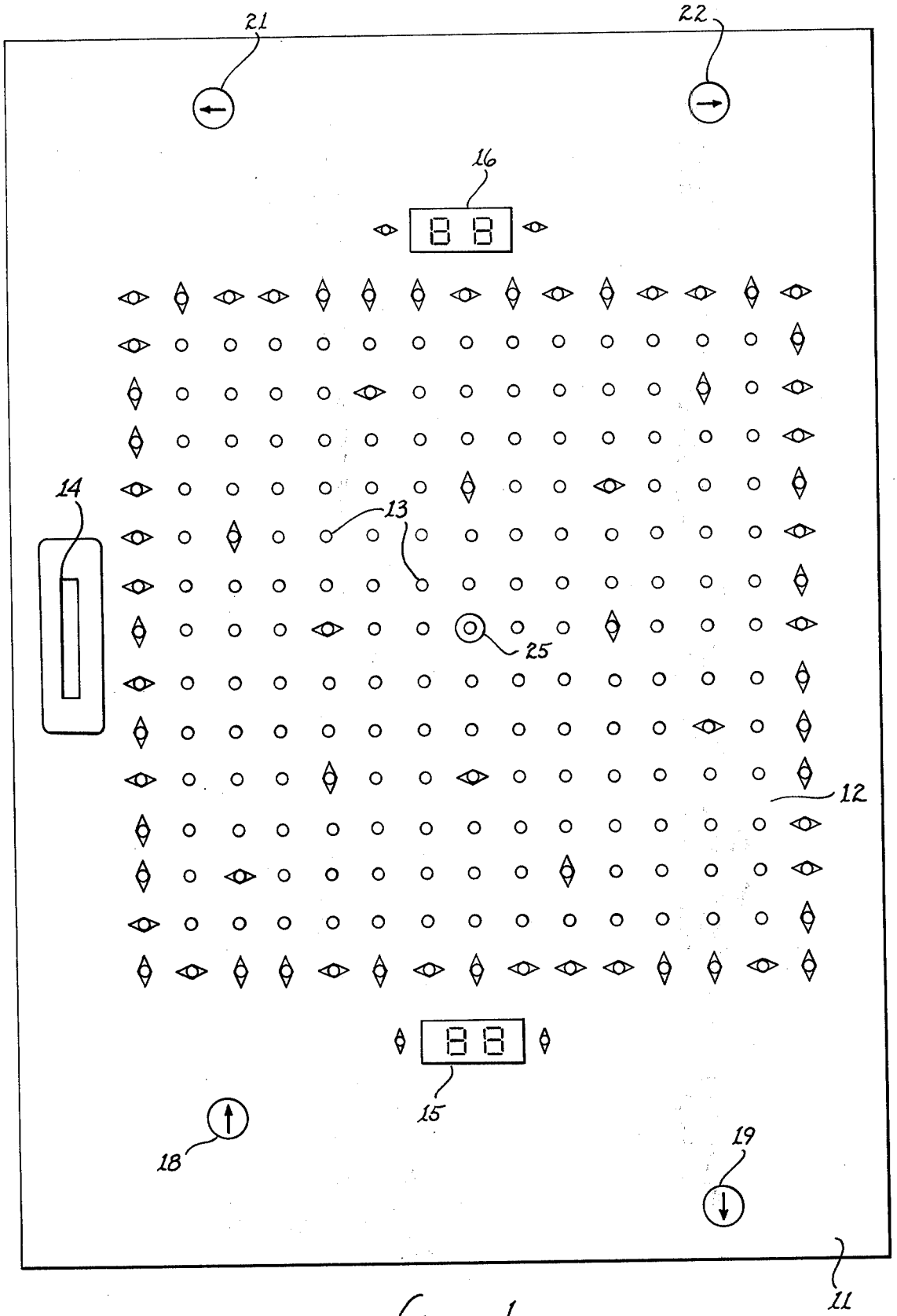
FIG. 1 is a plan view of a tabletop game embodying this invention.

FIG. 1 shows a coin-operated, tabletop game embodying this invention. A tabletop 11 includes a matrix play area 12 having a fifteen by fifteen square array of lamps 13. The game is initiated by inserting a coin into coin slot 14. The player control buttons, which will be explained later in detail, include a pair of buttons 18 and 19 controlled by a green player and another pair of buttons 21 and 22 controlled by a yellow player. The green and yellow scores are recorded by score displays 15 and 16, respectively.

Certain of the lamps 13 of matrix 12 have distinguishing designations. For example, although the lamps 13 are ordinarily red in color, those distinguished with a ◊ designation represent "target" positions for the green player, while those distinguished with a <> designation are yellow player target positions (the significance of which will be explained later). Also, the center most lamp 25 is designated by a red dot surrounding it.

RULES OF THE GAME

The rules of the game are simple. The object is to score more points than your opponent. During play, one lamp 13 of matrix area 12 is lighted. The green player can move the position of the lighted lamp forward or backward along one axis while the yellow player moves the position of the lighted lamp left or right along the other axis. By controlling the movement of the lighted square, either player may cause one of his associated target lights to be lighted. Whenever a target light is lighted, the associated player is awarded a point. The strategy of the game evolves around the concept of moving the lighted lamp to light your own target lamp while preventing your opponent from lighting one of his target lamps.

PLAY OF THE GAME

Figure 2:
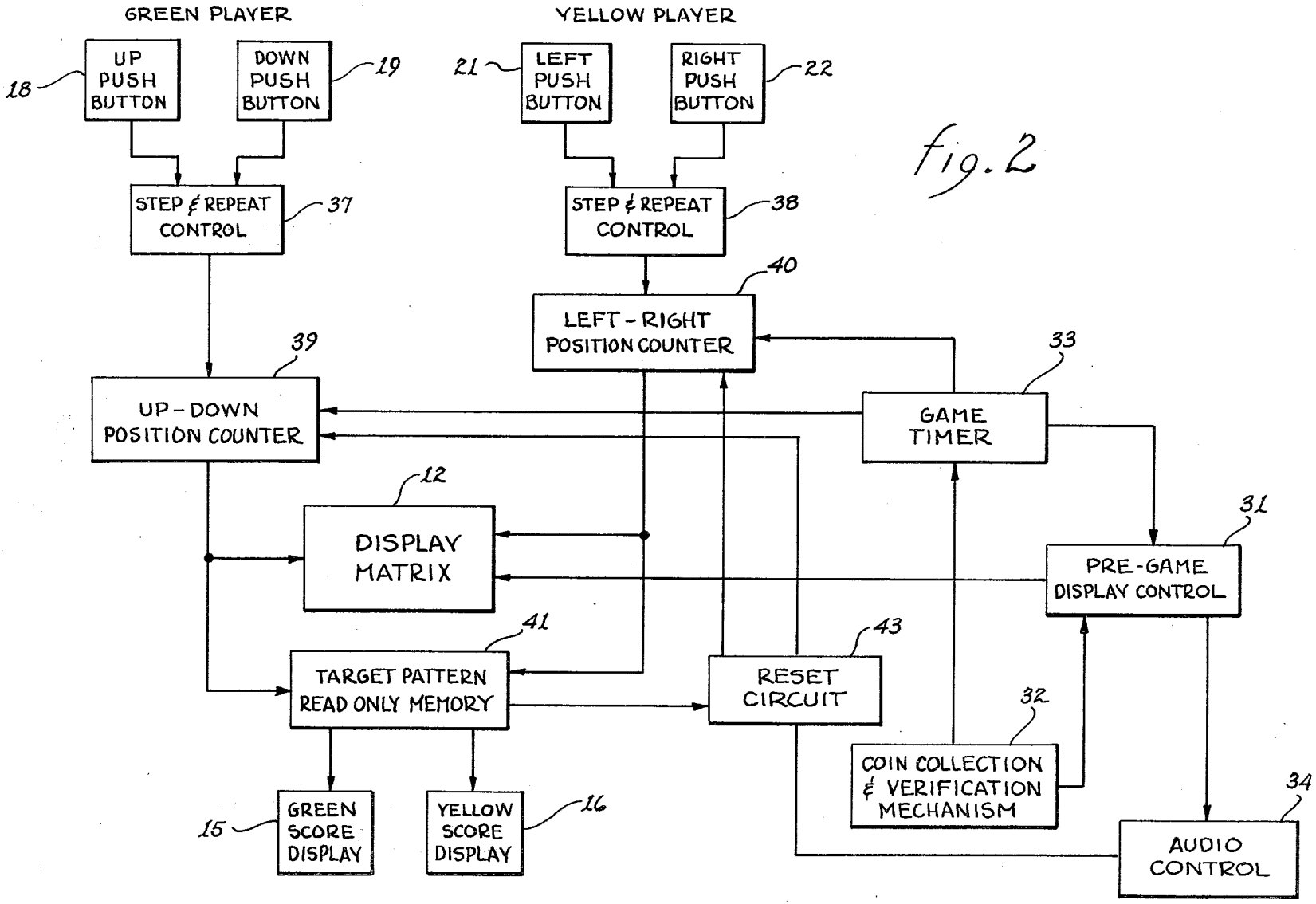
FIG. 2 is a schematic block diagram of the electrical control circuitry of the game shown in FIG. 1.

Before the game begins, a "display" appears on the play area to attract the attention of potential players. The display comprises the sequential illumination of the 56 lamps forming the periphery of the matrix 12. An audible tone is generated to accompany the display. The sequential operation of the game is shown functionally in FIG. 2 where the display and audible tone are controlled by a pre-game display control 31.

When a coin is inserted in slot 14, a coin collection and verification mechanism 32 ascertains that a genuine coin of proper value has been inserted. Although the mechanism is not shown in detail, such mechanisms are commonly used and are well understood by those skilled in the art. After mechanism 32 verifies that an appropriate coin has been inserted, a game timer 33 is enabled to interrupt the pre-game display and light center lamp 25 thereby initiating play. Concurrent with the lighting of lamp 25, an audible "start" tone is produced by audio control 34.

Center lamp 25 remains lighted for one second to permit the players to prepare for their first move. Referring to the lighted lamp of matrix 12 as the "marker", play of the game involves controlling the movement of the marker in an attempt to score while preventing your opponent from scoring. The green player controls the up and down movement of the marker by selectively operating up button 18 or down button 19, respectively. Movement of the marker to the left and right is controlled by the yellow player's operation of his respective left button 21 or right button 22. Concurrent operation of a button by both the yellow and green players produces diagonal movement of the marker.

Timer 33 produces a 60 Hz reference signal which clocks a latch wired to each player button. Thus, up to 60 switch changes per second can be recognized by the step and repeat controls 37 and 38 associated respectively with the green and yellow players. Controls 37 and 38 each determine the number and identity of the pushed player buttons. If a player pushes no button, or both his buttons, no action is taken. If a single button is pushed, control 37 or 38 produces an appropriate change in the number stored in respective up-down position counter 39 or left-right position counter 40. Counters 39 and 40 combine to control the position of the marker on display matrix 12.

If a player position button is pushed briefly, then released, a single incremental movement of the marker will result. If that button is pushed and not released, controls 37 or 38 will produce repeated movement of the marker at a predetermined speed. However, the players can make the marker move even faster than the predetermined speed by repeatedly pushing and releasing the button.

The predetermined rate is adjusted by altering the inputs to controls 37 and 38. Although not shown, a speed adjustment knob could be added to the controls to permit the predetermined rate to be selected by the players. Further, separate speed adjustment knobs could be provided for each player to permit different predetermined rates to be selected along each axis. Still another modification would be to combine the up-down and left-right buttons into a single switch control operated with one hand of a player while the other hand controls the predetermined rate and the speed at which the marker is incremented across matrix 12.

Each time the position of the marker is changed by the outputs from counters 39 and 40, a target pattern read only memory 41 compares the electrical location of the marker with its stored locations of the green and yellow target lamps. If the marker moves to a target lamp, memory 41 operates a reset circuit 43 and adds a point to the appropriate score display 15 or 16. Reset circuit 43 operates to produce a "score" tone from audio control 34 and to return the marker to the center position by resetting counters 39 and 40.

Figure 3:
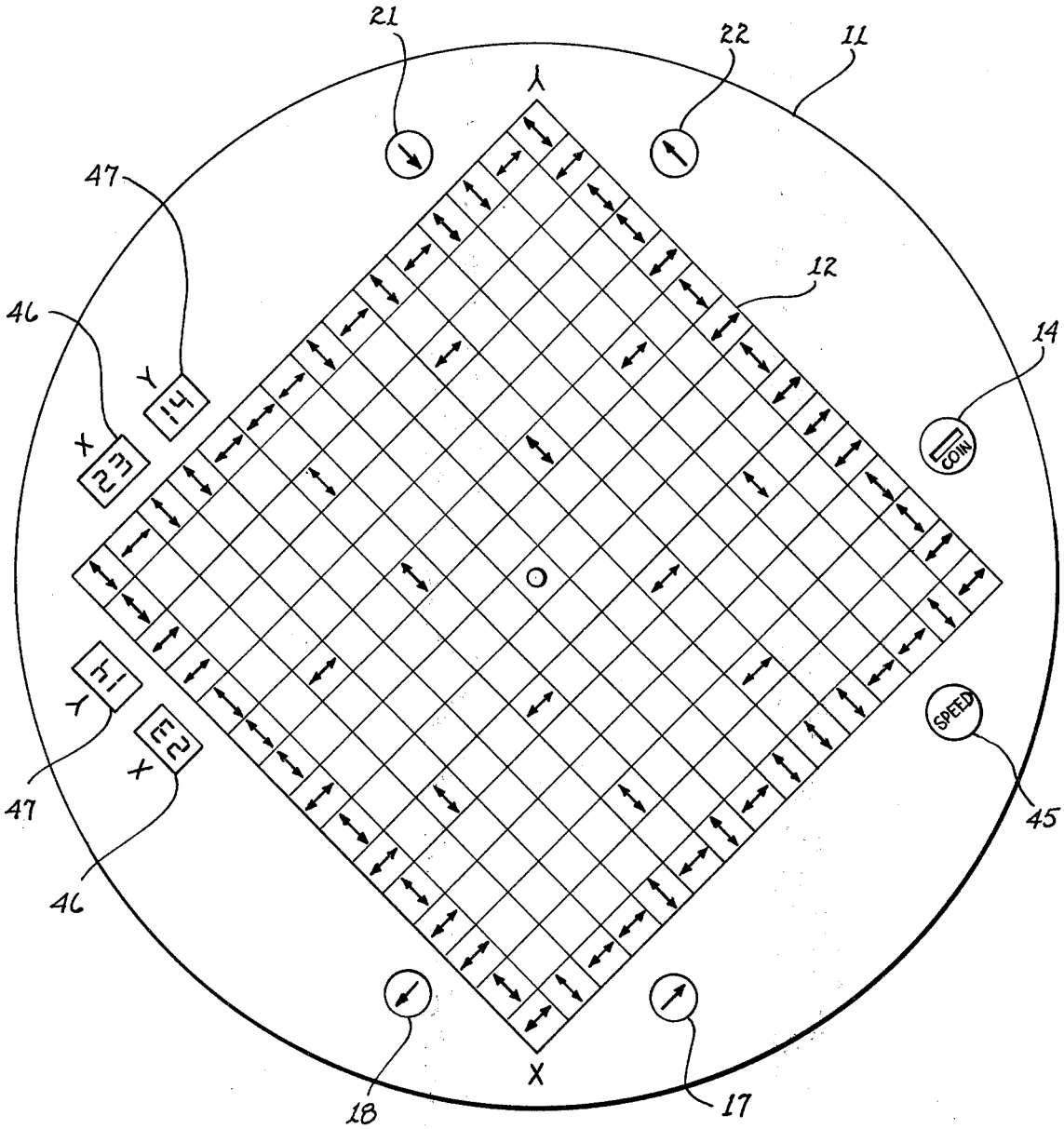
FIG. 3 is a plan view of an alternate embodiment of this invention.

Another embodiment of the game is shown in FIG. 3. Tabletop 11 still includes a matrix play area 12. However, rather than comprising a matrix of light bulbs, the matrix of this embodiment comprises a 15 by 15 array of contiguous squares illuminated on a video display screen. The marker of this embodiment moves similarly to the marker of the embodiment of FIG. 1, except all squares are lighted and the marker is extinguished. If the marker is moved to a target square, the score on the score display 46 or 47 associated with player X or player Y, respectively, is increased. As suggested earlier, the predetermined rate may be adjusted using speed control knob 45.

For home use, coin slot 14 and mechanism 32 could be replaced with a start button to initiate play. To maximize profits, coin-operated games could have provision to terminate a game at the end of a predetermined period, such as two minutes, regardless of the score totals. The "pre-game display" would then be resumed with the score total remaining until another coin is inserted. This timing provision, as well as the pre-game display, scoring displays and audio tones could be eliminated for home use games.

Although particular arrangements of scoring targets have been shown, it should be apparent that a virtually unlimited number of arrangements could be used. It is suggested, however, that at least one target position appear for each player along each axis to prevent a player's scoring attempts being prevented by his opponent's failure to advance the marker along his controlled axis.

Each embodiment has been described as being played between two players. It should be clearly understood that other variations are possible. For example, pairs of players could compete with one pair operating buttons 18 and 19 and their opponents each operating one of buttons 21 and 22. This would require coordinated movement between the playing pairs, but that could be obtained with practice. Also, a single player could challenge "the machine" by providing a robot player utilizing memory-logic capacity for one of the counters 39 or 40.

Embodiments utilizing only two-axis matrices have been described. However, multi-axis matrices may also be utilized. For example, a three-axis matrix utilizing hexagonal elements could be used, resulting in a game with up to six players. Even more elaborate, third dimensional game arrangements, utilizing multi-level game boards, could be utilized to increase both the complexity of the game strategy and the maximum number of players.

Another alternative to be considered, particularly for very skilled players, is to replace the designation of the center position for the marker at the inception of a point with a random selection of the marker position. This would demand rapid response by the players since the initial maneuver could not be anticipated.

These and other alternatives and modifications could be made by those skilled in the art without departing from the spirit and scope of this invention. For example, although the embodiments described have been tabletop games, it should be apparent that they are equally adapted for wall display games. Further, although a pre-game display was described for the period between games, particularly for coin-operated versions, the game board could be completely extinguished between games, if so desired. Also, for home use, or to provide interest in coin-operated versions, the timed game could be replaced by a score total ending game, or by a combination of time and score. A free game could be awarded if a score in excess of some established total is achieved within a time limit.

What I claim is:

1. An electrically operated game played between a first player and a second player, said game comprising, in combination:

a. a play area formed by a plurality of contiguous elements arranged on a matrix having at least two axes, said elements including
   i. a plurality of neutral elements; and
   ii. a plurality of scoring elements associated with each player, said scoring elements being located among said neutral elements and dispersed across said play area;

b. means for designating one of said contiguous elements;

c. means for incrementally moving the location of said designated element to a contiguous element;

d. means operable by said first player for moving said designated element a single increment along a first axis of the matrix of said play area when said operable means is momentarily operated;

e. means operable by said second player for moving said designated element a single increment along a second axis of the matrix of said play area when said operable means is momentarily operated; and f. means for indicating a score for one player whenever said designated element is also a scoring element associated with said one player.

2. A game in accordance with claim 1 further including means for selectively altering the periodicity of the incremental movement of said designated element.

3. A game in accordance with claim 1 wherein the matrix arrangement of said play area forms rows and columns of said elements.

4. A game in accordance with claim 1 wherein each axis of the matrix of said play area includes at least one scoring element associated with each player.

5. A game in accordance with claim 1 further including means for audibly signaling a score for a player whenever said designated element is also a scoring element associated with said one player.

6. A game in accordance with claim 1 wherein said means operable by said first player and said means operable by said second player each move said designated element a single increment when momentarily operated and a plurality of increments in rapid succession when steadily operated.

7. A game in accordance with claim 1 further including means for visually displaying the score associated with said first and second players.

* * * * *